United States Patent [19]

Abenaim

[11] Patent Number: 4,598,802

[45] Date of Patent: Jul. 8, 1986

[54] FOLDABLE FRAME TYPE LUGGAGE

[76] Inventor: Jacques Abenaim, 12 Joliet Street, Saint-Bruno, Canada, J3V 4Z1

[21] Appl. No.: 655,538

[22] Filed: Sep. 28, 1984

[51] Int. Cl.[4] ..... A45C 7/00; A45C 13/22

[52] U.S. Cl. ..... 190/107; 190/115; 190/127

[58] Field of Search ..... 190/18 A, 21, 22, 100, 190/103, 104, 105, 107, 122, 115, 111, 126, 127; 220/4 F, 6, 76

[56] References Cited

U.S. PATENT DOCUMENTS

| | | | |
|---|---|---|---|
| 2,169,892 | 8/1939 | Bevington | 220/76 |
| 2,536,169 | 1/1951 | Gray | 190/103 |
| 2,718,943 | 9/1955 | Braverman | 190/107 |
| 3,176,326 | 4/1965 | Zysman et al. | 190/115 X |
| 3,504,772 | 4/1970 | Barry | 190/105 |
| 3,647,035 | 3/1972 | Honig | 190/103 |
| 4,140,164 | 2/1979 | Staup | 190/107 X |
| 4,160,496 | 7/1979 | Knight | 190/107 |
| 4,418,804 | 12/1963 | Bradley et al. | 190/127 X |
| 4,472,870 | 9/1984 | Kotkins, Jr. | 190/122 |

FOREIGN PATENT DOCUMENTS

| | | | |
|---|---|---|---|
| 1532839 | 2/1969 | Fed. Rep. of Germany | 190/122 |
| 1632530 | 1/1970 | Fed. Rep. of Germany | 190/127 |
| 948385 | 2/1953 | France | 190/119 |
| 1191799 | 4/1959 | France | 190/107 |
| 1235869 | 5/1960 | France | 190/115 |
| 1427179 | 12/1965 | France | 190/107 |
| 139570 | 3/1953 | Sweden | 190/119 |
| 333019 | 8/1930 | United Kingdom | 190/122 |

OTHER PUBLICATIONS

"Popular Science", Jan. 1947, p. 110.

*Primary Examiner*—William Price
*Assistant Examiner*—Sue A. Weaver

[57] ABSTRACT

This foldable frame type article of luggage comprises a central band-like frame and front and back flexible wall panels detachably connected to the peripheral edges of the frame. The frame includes a rigid, shallow, U-shape member defining the bottom portion and minor adjacent parts of the respective side portions of the frame and a pair of flexible band-like legs detachably joining together at the middle of the top portion of the frame at one end and transversely hinged to the ends of the U-shape shallow member at the other end, whereby said legs can be collapsed against said shallow U-shape member, when the side wall panels are detached, for storing the article of luggage in a minimum of space. When the side wall panels are fully attached to the frame, they maintain said frame in erected position. In accordance with a second embodiment, the legs are in telescopic engagement with the shallow U-shape member and there are provided at least two sets of front and back flexible wall panels, whereby the same frame can form article of luggages of different sizes.

5 Claims, 16 Drawing Figures

6
6
21
3,7
5
1
3,7
17

7'
22
21
22
1
10
6
7
5
3
4
3
11
3
10
5
17
5
5
18
3

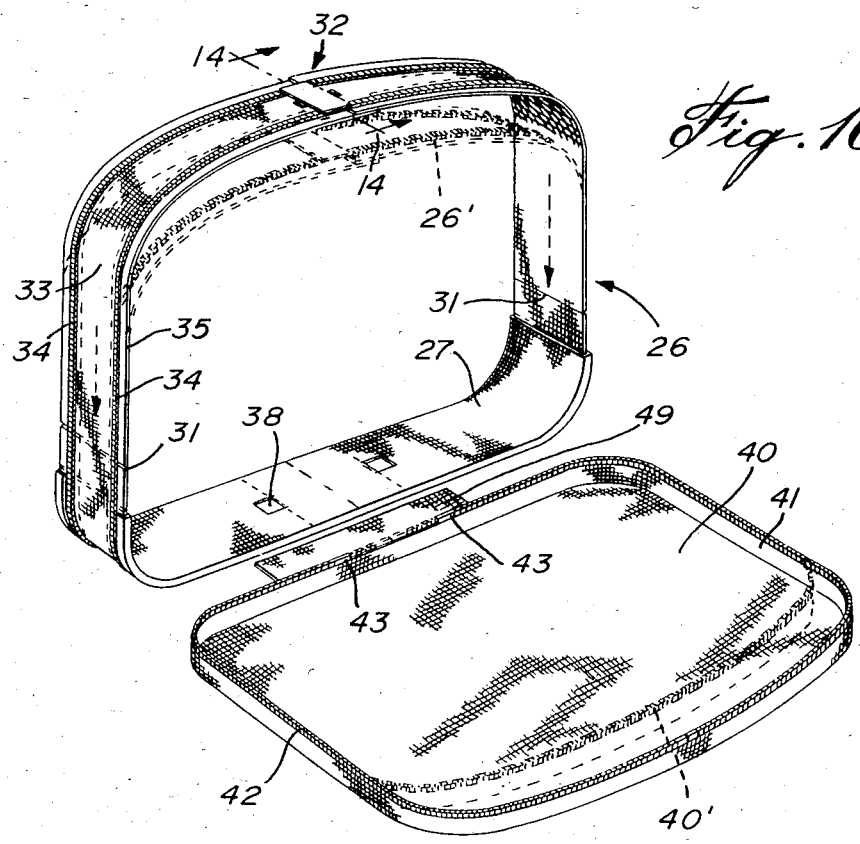
Fig. 10
Fig. 15
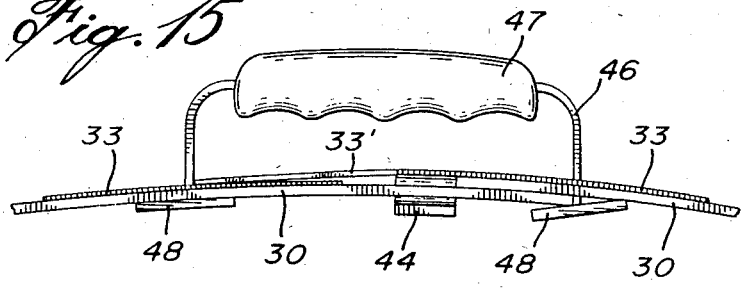
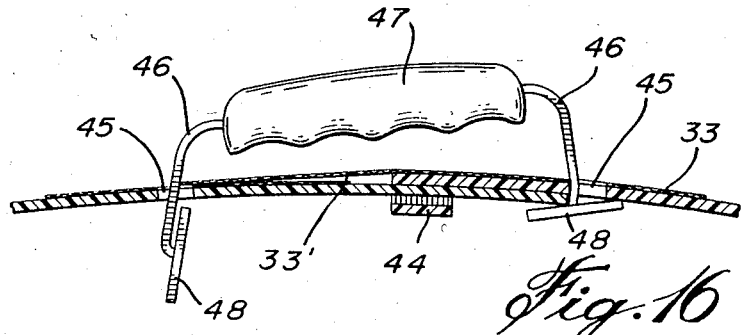
Fig. 16

Fig. 11
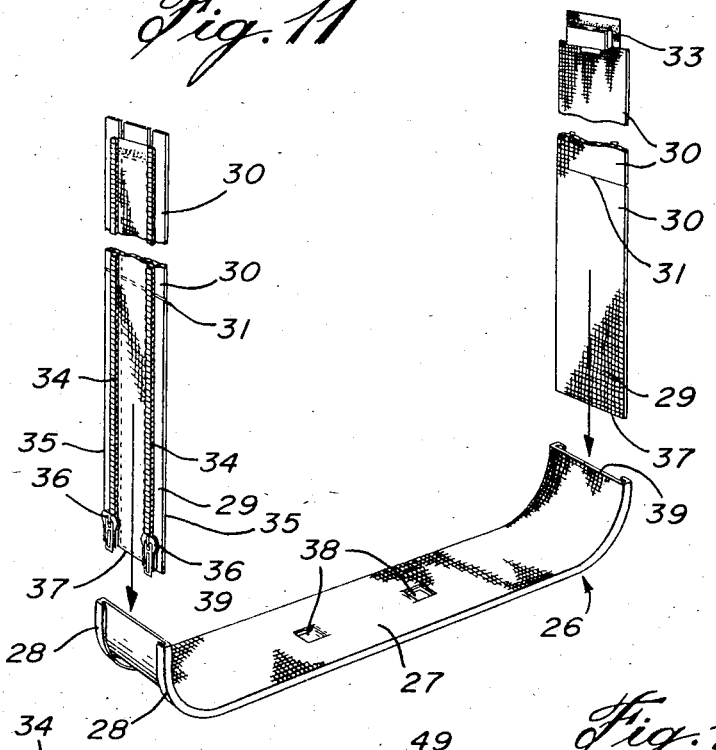
Fig. 12
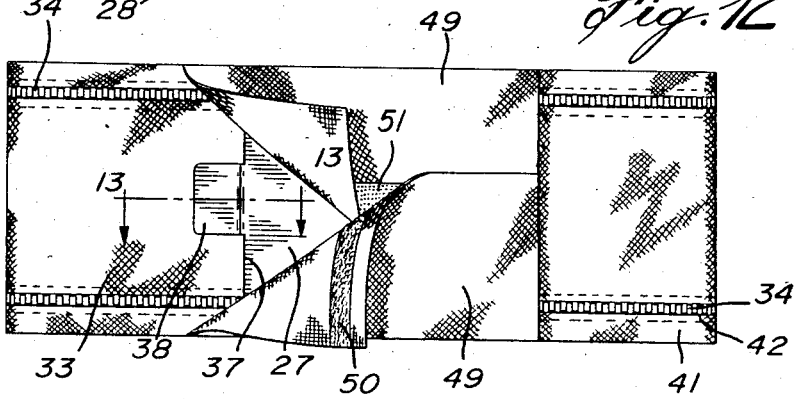
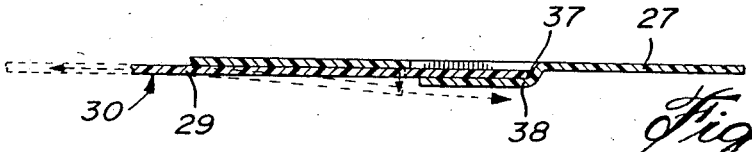
Fig. 13
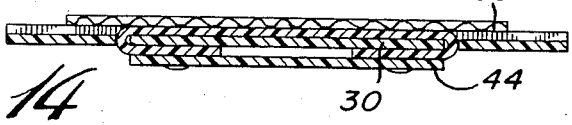
Fig. 14

FOLDABLE FRAME TYPE LUGGAGE

FIELD OF THE INVENTION

The present invention relates to a frame type article of light-weight construction and, more particularly, to such an article of luggage which can be easily collapsed into a minimum of space for storage when not in used.

BACKGROUND OF THE INVENTION

It is known to provide an article of luggage including a band-like frame, to the peripheral edges of which are attached flexible wall panels. However, these articles of luggage are not collapsible and, therefore, occupy their full size in storage. Due to the fact that available storage space in apartments and homes is becoming more and more restricted, it is desirable to provide a frame type article of luggage which can be easily collapsed to occupy a minimum of storage space when not in use.

OBJECTS OF THE INVENTION

Accordingly, it is the main object of the present invention to provide an article of luggage which has a rigid frame, this frame being capable of being collapsed or folded to form a compact assembly for storage purposes.

Another object of the invention is to provide an article of luggage of the character described, which is of simple and inexpensive construction and which, in accordance with one embodiment has a frame made of a one-piece construction.

Another object of the present invention is to provide an article of luggage of the character described in which the frame is of adjustable dimensions to be used in connection with sets of front and back panels of different sizes, in order to obtain articles of luggage of various capacities, using the same frame.

SUMMARY OF THE INVENTION

The frame-type of article luggage of the present invention comprises a band-like frame having front and back peripheral edges and front and back tension-resistant and flexible wall panels attachable to the front and back peripheral edges of the frame, respectively, to define an enclosure. The frame defines a bottom portion, side portions and a top handle-carrying portion. A rigid, shallow U-shape member defines the bottom portion and minor adjacent parts of the respective side portions of the frame. The frame further includes two band-like leg members which are longitudinally flexible and which are hinged at one end at the respective ends of the U-shape member about transverse hinge axes, while the free ends of the respective legs are releasably joined together at about the middle of the top portion. Therefore, when the side panels are detached, the two legs can be collapsed in overlapping relation against the U-shape member. The front and back panels, when fully attached to the peripheral edges of the frame, maintain said frame in erected position.

In accordance with a second embodiment, the two legs are telescopically engageable with the shallow-U-shape member, so as to vary the size of the frame, and there are provided at least two sets of front and back panels of different sizes.

BRIEF DESCRIPTION OF THE DRAWINGS

FIG. 10 is a perspective view of the second embodiment of the article of luggage of adjustable dimension;

FIG. 11 is an exploded perspective view of the frame of the second embodiment;

FIG. 12 is a bottom plan view of the second embodiment of the article of luggage;

FIG. 13 is a partial longitudinal section, taken along line 13—13 of FIG. 12;

FIG. 14 is a cross-section of the assembled top portion of the frame and taken along line 14—14 of FIG. 10;

FIG. 15 is a partial elevation of the top portion of the frame of the second embodiment and showing the luggage-carrying handle in operative position; and FIG. 16 is a longitudinal section showing the same elements as in FIG. 15.

DETAILED DESCRIPTION OF THE TWO PREFERRED EMBODIMENTS OF THE INVENTION

Figure 1:
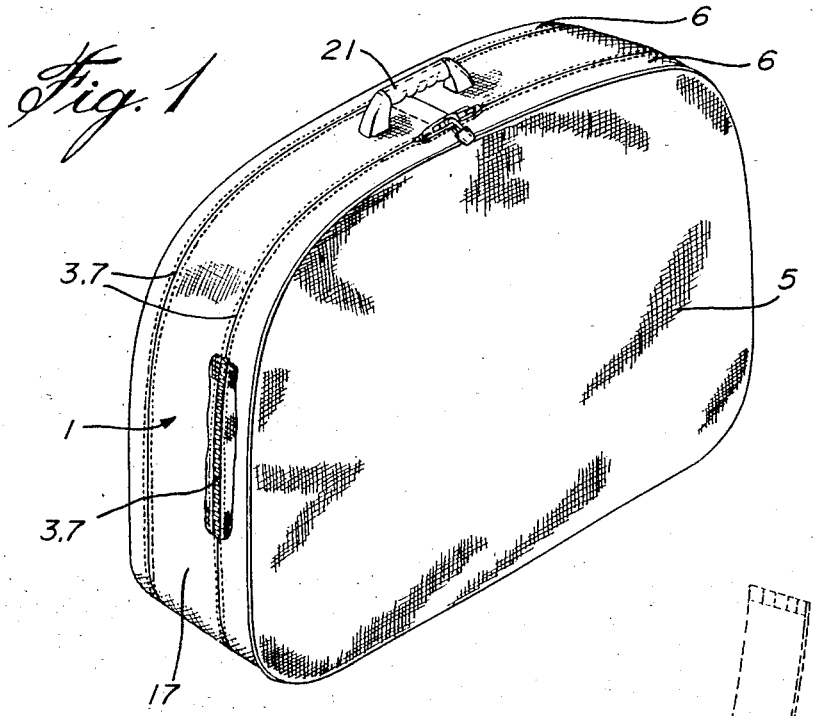
FIG. 1 is a downwardly-looking perspective view of the first embodiment of the frame type article of luggage of the invention.
Figure 2:
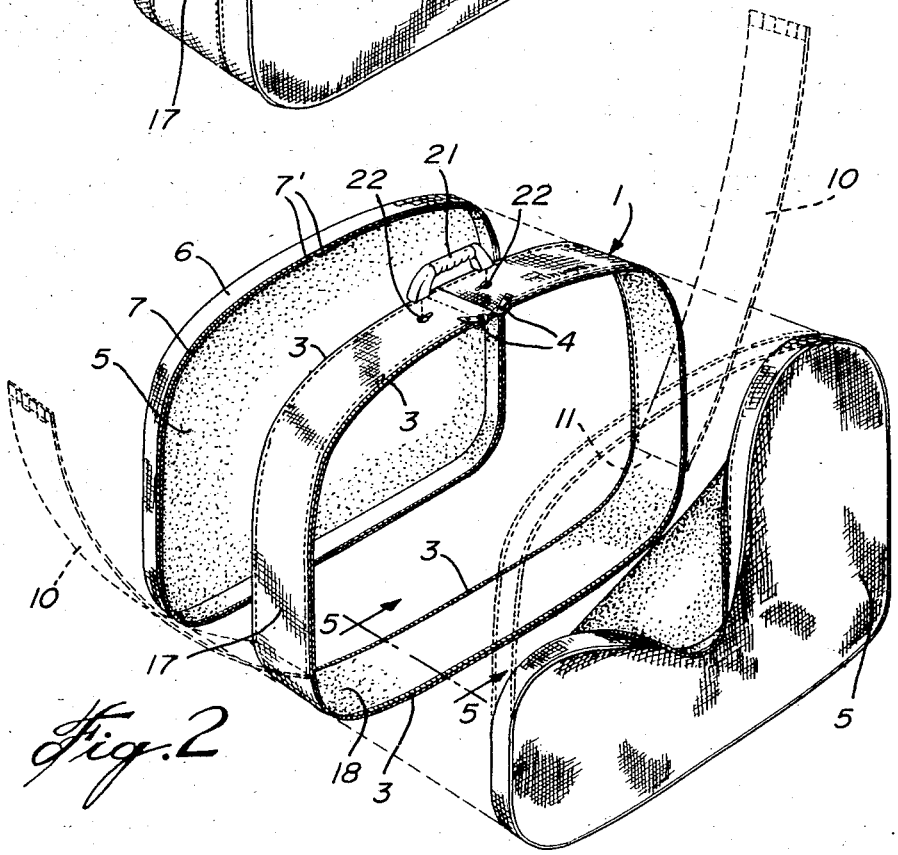
FIG. 2 is an exploded perspective view of the same embodiment.
Figure 3:
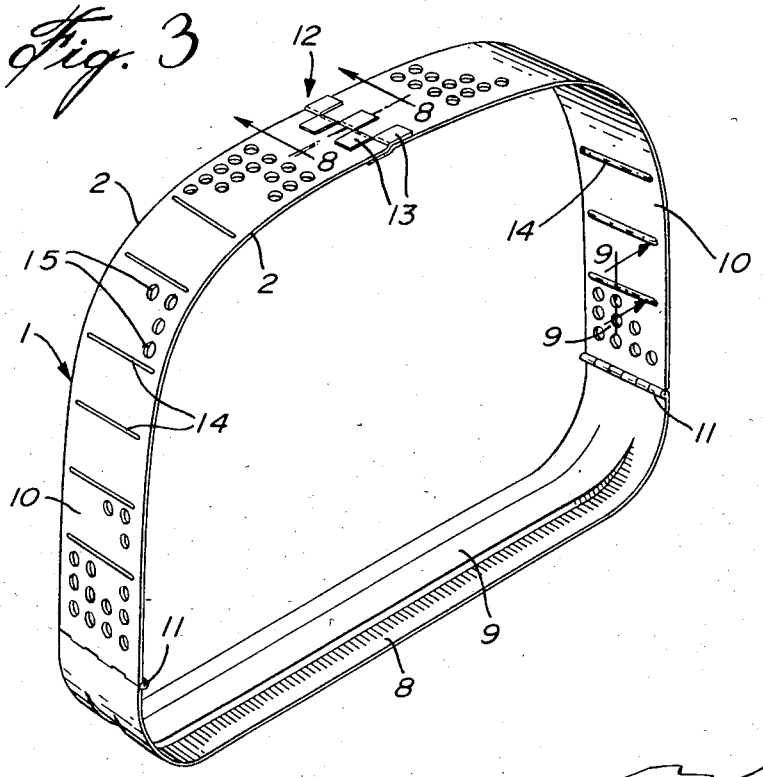
FIG. 3 is a downwardly-looking perspective view of the band-like frame member in erected position.

Referring to FIGS. 1, 2, and 3, the article of luggage in accordance with the first embodiment comprises a central band-like frame 1 having front and back peripheral edges 2, each provided with one strip 3 of a slide fastener assembly including sliders 4. The article of luggage further includes front and back flexible panels 5, each having an inturned marginal lip 6 fitted at the periphery thereof with the other strip 7 of the slide fastener assembly, whereby the two panels 5 can be attached along their entire periphery to the peripheral edges 2 of the frame 1 by joining the teeth-carrying strips 3 and 7 by means of the sliders 4. In the example shown, the two panels 5 are completely detachable from frame 1 due to the free end tabs 7' of fastener strip 7.

As shown in FIG. 3, frame 1 may be made of metal or a synthetic resin and forms a band defining the bottom portion, the side portions and the top portion of the article of luggage. A shallow, U-shape member 8 forms a bottom portion and a minor part of each side portion; said U-shape member has a longitudinally-extending central rib 9 to make the member more rigid. Two band-like legs 10 are hinged at one end by means of transversely-extending piano hinges 11 to the free ends of U-shape member 8. Each leg 10 forms a major part of the side portions of the frame and join at the middle of the top portion of the frame at the junction 12 formed by the free ends of legs 10.

Figure 4:
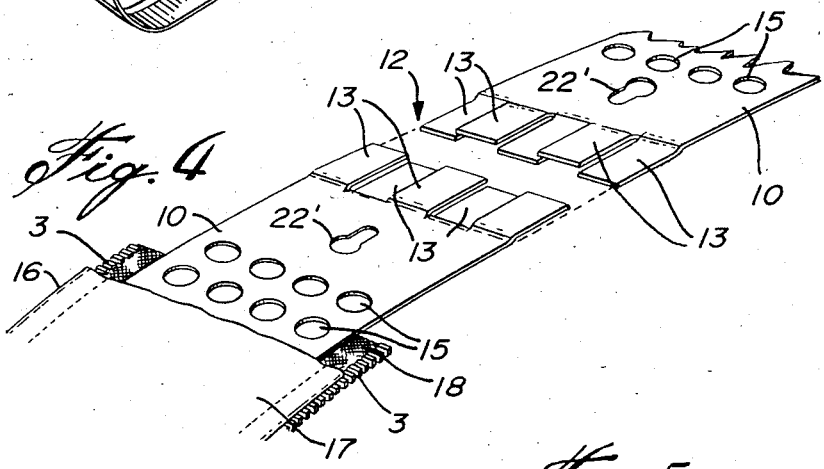
FIG. 4 is a partial perspective view showing the coupling assembly at the top portion of the frame between the two flexible legs of the frame.

As more particularly shown in FIG. 4, the free end of each leg 10 has a series of longitudinally-extending tabs 13 which are transversely successively offset with respect to each other for interdigitating engagement with the similar tabs 13 of the opposite leg 10. The legs 10 are longitudinally flexible, so that, normally, they are longitudinally straight but can be curved to form the side and top portions of the frame of the luggage when the legs 10 are joined together at junction 12. Each leg 10 is preferably transversely reinforced by transverse ribs 14 and are perforated by a multiplicity of holes 15 to make the frame as light as possible.

Figure 6:
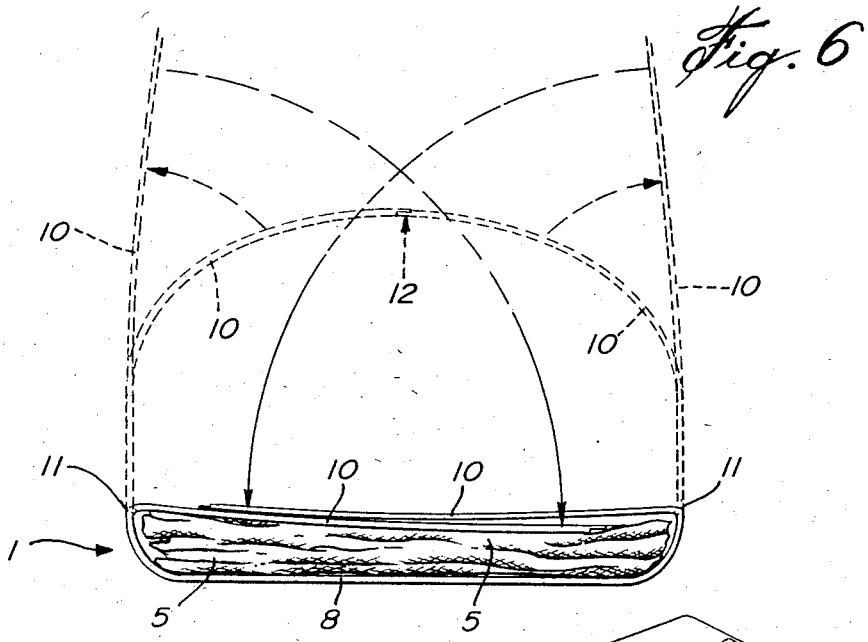
FIG. 6 is an elevation of the collapsed article of luggage shown in full line and showing in dotted line how the legs of the frame are uncoupled and collapsed.

As shown in FIG. 6, the length of each leg 10, when straightened out, is slightly less than the length of the shallow U-shape member 8, so that the two legs 10, when detached from each other at junction 12, can be folded by the respective hinges 11 to a collapsed overlapping position within the confine of the U-shape member 8. In this position, the two foldable wall panels 5 can be stored within the U-shape member 8 underneath the folded legs 10. These side panels are tension-resistant as well as flexible, so that, when they are attached to the periphery edges of the frame, they maintain said frame in erected position and against deformation.

Figure 5:
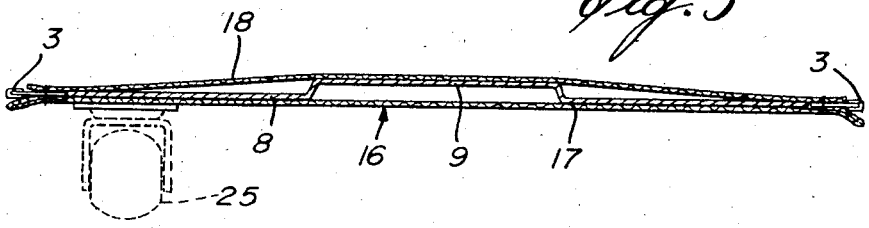
FIG. 5 is a cross-section of the bottom portion of the frame, taken along line 5—5 of FIG. 2.

Preferbly, the entire frame 1 is inserted within a flat sleeve-like member 16, as shown in FIGS. 4 and 5, said sleeve-like member formed of flexible outer and inner layers 17 and 18 stitched at their peripheral edges and together with the slide fastener strips 3 for the front and back panels of the article of luggage.

Figure 9:
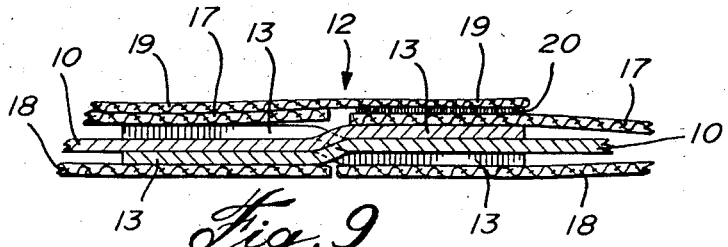
FIG. 9 is a partial longitudinal section, taken along line 9—9 of FIG. 3.

As shown in FIG. 9, the free ends of the inner layer 18 form a butt joint at junction 12, while one end of the outer layer 17 is provided with an extension piece 19 adapted to overlap the other end of the outer layer 17 and be removably fixed thereto by means of pressure layer bands 20, each as a pressure connection known under the registered trade name VELCRO, so as to overlie and cover the interdigitated tabs 13 at junction 12 of the frame. As shown in FIGS. 1 and 2, a luggage-carrying handle 21 is detachably connected to the frame 1 across the junction 12. The handle 21 has at its outer edges headed studs, not shown, which are engageable with the respective bayonnet holes 22 formed in the outer layer 17 of the sleeve 16 and also through registering bayonnet holes 22' (see FIG. 4) made in the outer end of the respective legs 10. Therefore, the handle 21 serves not only to carry the article of luggage but also to keep the two legs 10 in joined condition.

Figure 7:
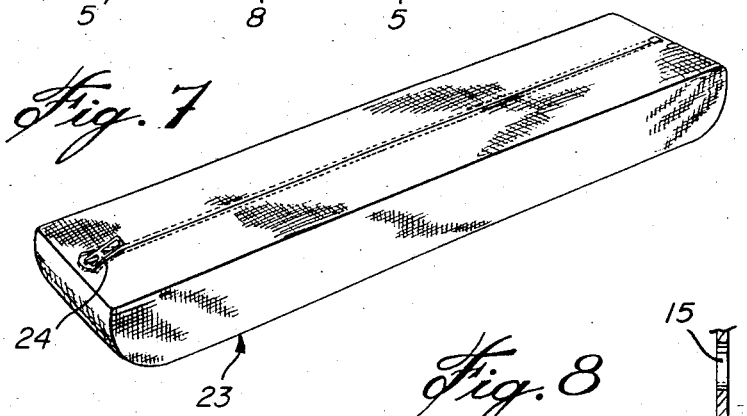
FIG. 7 is a perspective view of the collapsed piece of luggage enclosed in a protecting bag.
Figure 8:
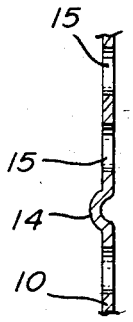
FIG. 8 is a partial longitudinal section, taken along line 8—8 of FIG. 3.

Handle 21, when detached from the frame 1, can be stored with the panels 5 within the collapsed frame 1. The entire collapsed assembly can be, if desired, inserted within a bag 23 (see FIG. 7) provided with a longitudinal opening slide fastener 24.

As shown in FIG. 5, the four corners of the shallow U-shape member 8 may be provided with caster wheels 25 for ease of rolling the article of luggage on the floor; these caster wheels 25 may be detachably connected to the frame 1. Obviously, each piano hinge 11 may be replaced by any type of hinge connection, for instance in the case where the frame 1 is made of synthetic material, each leg 10 may be an integral part of U-shape member 8 and joined by a hinge formed by a linear portion of restricted thickness of the material forming the frame.

The second embodiment of the invention is illustrated in FIGS. 10 to 16. In this embodiment, the central frame is adjustable in size and the same frame is used in association with at least two sets of side panels of different sizes, so as to provide an article of luggage of different capacities. The frame is generally indicated at 26 and consists of a band-like shallow U-shape member 27, of rigid construction, defining the bottom portion and a minor part of the side portions of the article of luggage. The edges of said U-shape member 27 are formed with outwardly and inwardly turned flanges defining external guideways 28 for slidably and telescopically receiving the bottom end portions 29 of two separate legs 30 in the form of bands which are longitudinally flexible and are preferably made of synthetic resin and are each provided with a transverse hinge 31 formed by a restricted linear zone made in the thickness of the leg. The portion of each leg 30 above hinge 31 defines the major part of the side portions of the article of luggage and also one half of the top portion of the article of luggage, such that the top free end of legs 30 are adapted to be coupled to each other at the junction 32. A layer of decorative fabric 33 is adhered to each leg 30 and is co-extensive therewith. A slide fastener strip 34 is secured to the fabric 33 adjacent the opposite peripheral edges 35 of legs 30 of the frame 26.

Each slide fastener strip 34 of each leg 30 is provided with a slide fastener slider 36, as shown in FIG. 11. The legs 30 are engaged within the guideways 28 to a maximum telescoped position in which the bottom inner end 37 of each leg 30 abuts against a struck-out tab 38 (see also FIGS. 12 and 13) made on each side of the center line of the U-shape member 27.

In this position, the hinge 31 of each leg is close to but above the free ends 39 of the shallow U-shape member 27. In this position, the frame 26 has a minimum dimension heightwise, as shown in dotted line at 26' in FIG. 10. However, both legs 30 can be pulled out of the guideways 28 of U-shape member 27 to form a frame of larger dimensions heightwise, as shown in full line in FIG. 10.

Two flexible and tension-resistant wall panels 40 are provided, each having an inturned lip 41 to which is attached a slider fastener strip 42 terminating at the bottom of the panel 40 by free standing spaced slider engaging end tabs 43.

Two sets of side panels 40, each set of a dimension to fit the frame 26 in its retracted and extended position respectively, are provided. One of the larger panels 40 is shown in full line in FIG. 10, the other panel being identical, while the two smaller-size panels, heightwise, are not shown. The distance between the end tabs 43 will change from one set to the other of the side panels, in order to match the end portions of the teeth of the slide fastener strips 34 on the two legs 30, depending on the telescoped position of said legs within U-shape member 27. Therefore, in each case, the panels can be completely attached to and detached from the frame 26 irrespective of the adjusted size of said frame. The outer ends of legs 30 join together at the middle junction 32 located at the middle of the top portion of frame 26. For instance, as shown in FIGS. 15 and 16, the outer ends of the legs 30 are arranged in overlapping position with one leg having inturned guiding flanges 44 slidably receiving the underlying end portion of the other leg 30. The decorative fabric 33 of the leg 30, provided with the guide flanges 44, is extended past said leg at 33' to overlap and be adhered to the fabric at the end of the other leg 30, for instance by a Velcro fastener.

Any other type of coupling arrangement could be provided between the two legs at 30, which allows quick coupling of the two legs. The top free end portions of the two legs 30 are each provided with a hole 45 on each side of the junction 32, each receiving the flexible end band 46 protruding from the respective ends of a rigid luggage-carrying handle 47. The outer end of each band 46 forms a transverse integral abutment plate 48 adapted to be also freely inserted through the hole 45 in the manner shown at the left-hand side of FIG. 16 and then has to take a flat position against the underside of legs 30 to prevent disengagement of the band 46 through the hole 45. The carrying handle prevents uncoupling of the adjacent ends of the legs 30. To uncouple the legs 30, at least one band 46 has to be disengaged from its hole 45. This is easily done by reaching the stop plate 48 from within the article of luggage and threading the stop plate 48 through the hole 45.

As shown in FIG. 10 and FIG. 12, the bottom central portion of each side panel 40 of each set is provided with a depending flexible flap 49 adapted to be folded about the outside of the central portion of the shallow U-shape member 27 and be arranged in overlapping position and secured to each other by means of snaps or by a pressure fastener of the type known under the registered trade mark VELCRO and shown at 50, 51 in FIG. 12. These flaps 49 are of such a width as to cover the otherwise-exposed central portion of U-shape member 27. Obviously, the flaps 49 will vary in width in each set of panels 40.

I claim:

1. A frame type article of luggage, collapsible from an erected, operative position to a collapsed storage position and having, when in erected position, a generally quadrangular shape, said article comprising a central band-like frame having opposite peripheral edges, a pair of flexible, foldable and tension-resistant wall panels releasably attachable to said frame along substantially the entire lengths of said opposite peripheral edges, slide fastener means to releasably attach said panels to said frame at said edges, said frame defining the bottom portion, the two bottom corner portions, the side portions, the two top corner portions and the top portion of said article when in erected position, said frame including a longitudinally and transversely rigid shallow U-shape member, and two longitudinally, resiliently flexible but transversely rigid, leg members which complete said frame, each leg having one end portion connected to an end of said U-shape member and having a hinge for folding of said leg about an axis transverse to said band-like frame, and each having an outer end, interengageable coupling means at the outer ends of the respective leg members to removably join said outer ends in substantial alignment, said U-shape member forming said bottom portion, said bottom corner portions and a minor adjacent part of each side portion and said leg members forming the major part of said side portions, the top corner portions and said top portion and said coupling means being located substantially at the center of said top portion when said article is in erected position with said side panels attached to said frame, said legs being then longitudinally flexed at said top corner portions and said side walls positively maintaining said leg members in said erected position, said leg members, when uncoupled and free of said side panels, taking a longitudinally straight position, the length of each straight leg being shorter than the distance between said ends of said U-shape member, said leg members, when uncoupled, foldable about said hinges in overlapping straightened-out position within said U-shape member and said side panels foldable and storable within said U-shape member under said folded, overlapped leg members, thereby defining the collapsed storage position of said article, and further including a handle detachably connectable to said top portion and straddling the outer ends of said leg members in the erected position of said article, to prevent uncoupling of said coupling means.

2. A frame type article of luggage as defined in claim 1, wherein said U-shape frame member has guideways along its opposite longitudinal edges and said leg members are telescopically engaged within said guideways, whereby the height of said frame can be varied and said panels including at least two sets of panels of different sizes, the panels of each set attachable to said frame.

3. A frame type article of luggage as defined in claim 1, wherein said coupling means includes interdigitable tabs formed at the outer ends of each leg member.

4. A frame type article of luggage as defined in claim 2, wherein the panels of each set has a depending flexible flap at its bottom edge, the flaps of the panels of anyone set adapted to be folded in overlapping position around the outside of said U-shape member to cover the exposed portion of said U-shape member, and means to releasably fasten said flaps in overlapping position.

5. An article of luggage as defined in claim 4, wherein said U-shape frame member has tabs forming abutments for the inner ends of the respective leg members and beyond which the latter cannot slide and defining the fully telescoped position of said legs with said guideways.

* * * * *